US005863269A

United States Patent [19]

Filice

[11] Patent Number: 5,863,269

[45] Date of Patent: Jan. 26, 1999

[54] JOINT SYSTEM FOR TWO-PIECE HOCKEY STICK

[75] Inventor: Gary W. Filice, Moorpark, Calif.

[73] Assignee: Jas. D. Easton, Inc., Van Nuys, Calif.

[21] Appl. No.: 889,084

[22] Filed: Jul. 7, 1997

Related U.S. Application Data

[63] Continuation of Ser. No. 701,575, Aug. 22, 1996, abandoned.

[51] Int. Cl.[6] ..... A63B 59/12

[52] U.S. Cl. ..... 473/562

[58] Field of Search ..... 473/562

[56] References Cited

U.S. PATENT DOCUMENTS 3,638,942 2/1972 Bassett ..... 273/67 A 4,086,115 4/1978 Sweet, Jr. et al. ..... 273/67 A

FOREIGN PATENT DOCUMENTS 2062635 9/1993 Canada ..... 273/67 A

*Primary Examiner*—Mark S. Graham

[57] ABSTRACT

A two-piece hockey stick shaft and blade joint system employing wax to hold the elements together during play, which may also include provision of a "pre-load" force acting between a shaft socket and blade tennon to increase frictional resistance to separation of the blade and the shaft so as to require a sustained steady pull be applied to separate the elements, the wax being substantially solid at temperatures encountered during play and flowable at elevated temperatures, for example such as might be attained in the shaft to blade connection by application of warmth from the hands or application of water heated sufficiently.

8 Claims, 2 Drawing Sheets

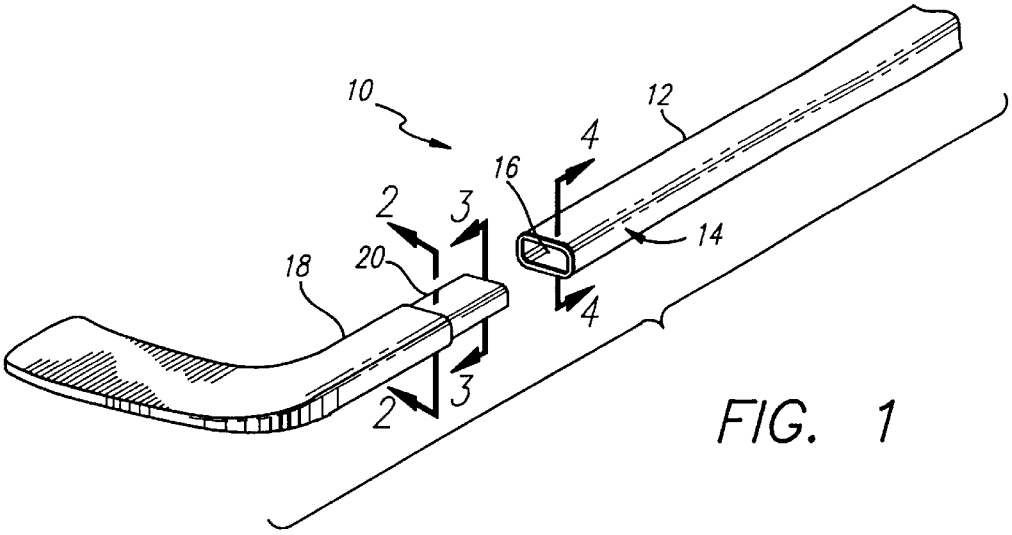
FIG. 1
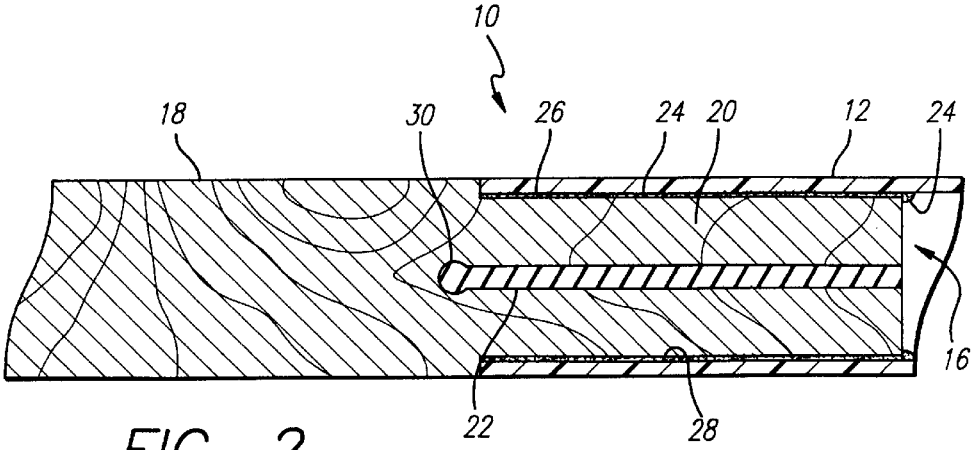
FIG. 2
FIG. 4
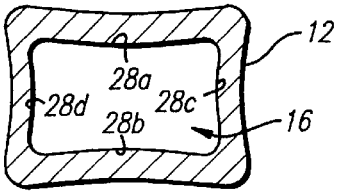
FIG. 3A
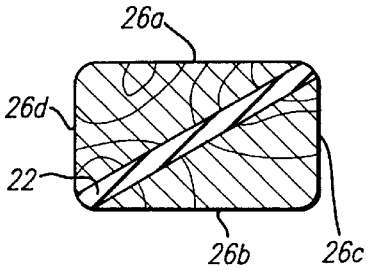
FIG. 3B
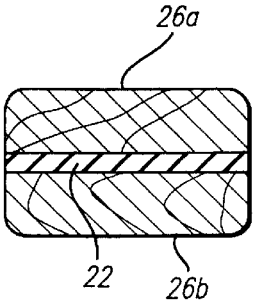

FIG. 5
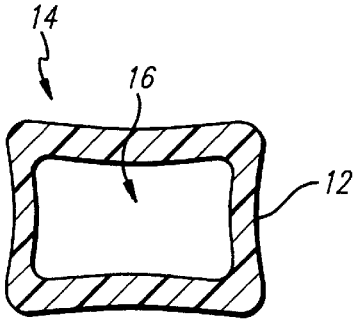
FIG. 6
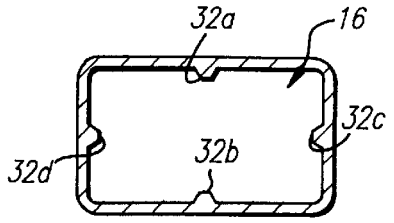
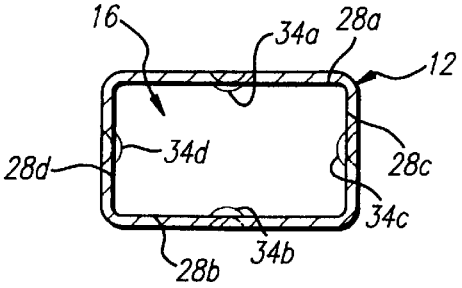
FIG. 7
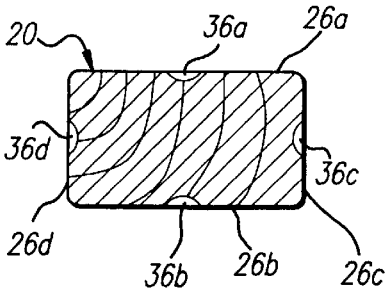
FIG. 8
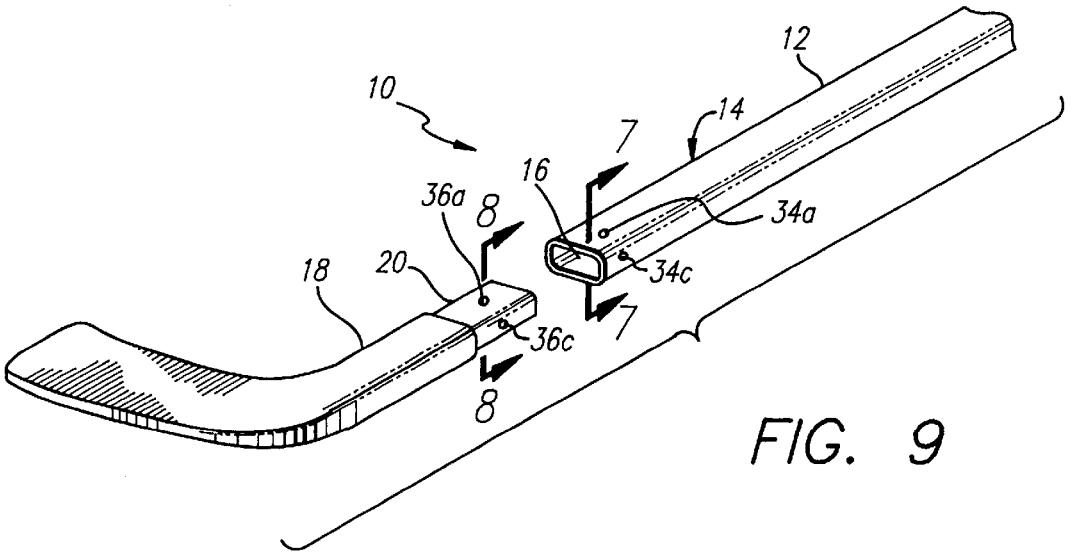
FIG. 9

JOINT SYSTEM FOR TWO-PIECE HOCKEY STICK

This application is a continuation, of application No. 08/701,575, filed Aug. 22, 1996, now abandoned.

BACKGROUND OF THE INVENTION

1. Field of the Invention

The invention relates generally to a hockey stick for use in playing hockey, the stick being of the type having a shaft and a replaceable blade, which blade is firmly affixed to the shaft for play, and which blade is loosened to allow changing of the blade by application of heat to the hockey stick at the juncture of the replaceable blade and the shaft. The invention more specifically relates to an improved system for releasably joining the blade to the shaft in such sticks.

2. Description of the Related Art

Hockey sticks for playing the game of hockey historically were made of wood and included a shaft and a blade. More recently, advances in the art have given rise to hockey sticks having components formed of other materials, such as aluminum and composite materials, for example fiber/resin composites incorporating epoxy and graphite. These newer materials are used because they give rise to advantages in weight and balance of the hockey stick and in its flexural properties. Replaceable blades are another more recent advance, and are generally formed of wood overlaid with a composite material such as fiberglass to strengthen the blade and provide increased durability. The blade is also often made of a polymer resin or a composite, which may also contain a fiber filler for example, to give increased strength and wear resistance. Such blades have a shank, or tennon, portion which is inserted into and interfits with a socket formed by an open end of the shaft of known hockey sticks. Such sockets are generally rectangular in shape, to match the shaft and to prevent twisting of the blade with respect to the shaft. The tennon must be securely held in the shaft, as "fly out" of a blade during play is highly undesirable.

Blades must be changed periodically due to wear or damage. In the most widely used configuration, the shank is held within the socket and is thus attached to the shaft by the use of a thermoplastic adhesive, commonly known as a "hot melt" glue. Conventionally, such a hot melt glue is liquefiable at temperatures well above that normally encountered in using a hockey stick and conventionally requires use of a high temperature heat source such as an electric heater recommended by the manufacturer, or by use of a torch which is often employed regardless of manufactures' recommendations and warnings to the contrary. When liquified by application of heat, such an adhesive allows removal or installation of a blade; and when allowed to cool, solidifies and adhesively bonds together the shaft and the shank of the blade.

Generally, manufacturers of hockey sticks recommend specific methodologies for heating the shaft of the hockey stick at the location of the hot melt glue-bonded connection at the end of the shaft. Such methodologies feature limiting the maximum temperature of the shaft to a material dependent value which allows liquefaction of the thermoplastic adhesive but is not injurious to the material from which the hockey stick shaft is made. Certain materials, specifically composite materials commonly used in forming the shaft, are susceptible to damage and weakening as a result of heating them to high temperatures, such as may be occasioned by using a torch or other open flame for example, to heat the shaft in carrying out a blade change, for example.

However, it is often desirable to change a blade quickly, and when using a hot melt glue connection recommended methods of heating the shaft to effect a blade change take a relatively long time. Consequently, faster ways of heating are commonly employed by hockey players to heat the end of the shaft regardless of manufactures' recommendations and warnings. Particularly, during a game, players in a hurry to change a damaged blade, for example, may use a high temperature heat source such as a propane torch or the like, providing a rapid transfer of heat energy to the shaft to facilitate a faster blade replacement. Use of a torch is universally recognized as hazardous, and accordingly neither method is without drawbacks. Common to both is the necessity to heat the shaft to a high temperature, which in-and-of-itself is not ideal.

When using a flame to heat a shaft-blade connection of a composite shaft hockey stick, degradation of the structural properties important to strength and flexibility of the shaft often results, and breaking of such hockey sticks along the shaft at such a damaged location has been observed. The dangers attendant a hockey stick breaking in this manner during play are well known. At the least, such a damaged hockey stick may be rendered unusable when it is recognized that the portion of the shaft which receives the blade shank has been damaged, and a tight and reliable union between the shaft and the blade cannot thereafter be accomplished. Shafts formed of metals can also be damaged by overheating, for example by cracks which may develop due to stress induced by heating and cooling to and from a relatively higher temperature and by differential heating, which cracks may later propagate.

Lastly, using a torch or electric heater to effect a blade change is inconvenient. Moreover, it may limit the places where a blade can be changed due to availability of an electric power source, or due to regulations regarding open flames in buildings or certain outdoor areas for example. Also, added equipment costs to the player or sponsor results from the requirement to purchase and use the additional equipment required to carry out one of these heating methods.

The above concerns being recognized, there is an opportunity to advance the art by providing a hockey stick of the type having a replaceable blade which provides the advantageous properties of newer metal and composite materials, yet which allows repeated blade changes without the need for application of heat at very high temperatures, such as from a torch for example, but instead at much lower temperatures. The present invention is directed to such an advance.

SUMMARY OF THE INVENTION

The present invention accordingly provides a hockey stick of the type having two separable segments comprising a shaft segment and a blade segment and a releasable connection between the shaft and blade segments. Said releasable connection further comprises a socket incorporated in said shaft segment and a blade tennon configured to be removably received in the socket, and a wax disposed between said tennon and said socket. In a more detailed aspect, the wax is adapted to retain the blade tennon in the socket at temperatures encountered during hockey play, and to allow removal of the blade tennon from the socket at temperatures above those encountered during hockey play, and less than those required to effect a blade change using "Hot Melt" glue. In a further more detailed aspect, the socket configuration and tennon configuration and wax together cooperate to retain the tennon in the socket until the connection between the shaft segment and blade segment is intentionally released and the blade tennon is removed from the socket. The required heating can be more safely accomplished in the stick of the invention by application of much less heat than that required in current sticks.

BRIEF DESCRIPTION OF THE DRAWINGS

FIG. 1 is an exploded perspective drawing of a portion of a hockey stick.

FIG. 2 is a sectional view, taken along line 2—2 in FIG. 1 of a blade tennon of the invention, shown inserted into a socket at the end of a hockey stick shaft;

FIG. 3 is a cross sectional view taken along line 3—3 in FIG. 1 of a blade tennon of the invention;

FIG. 3*a* is a variation of a blade tennon show in FIG. 3;

FIG. 4 is a cross sectional view taken along line 4—4 in FIG. 1 of a socket portion of the hockey shaft, said socket having a perpendicular configuration in accordance with one embodiment of the invention;

FIG. 5 is a variation of the socket configuration shown in FIG. 4;

FIG. 6 is a sectional view of the socket of a hockey shaft illustrating a further embodiment of the invention;

FIG. 7 is a sectional view, taken along the line 7—7 in FIG. 9 of a further alternate embodiment of a socket;

FIG. 8 is a sectional view taken along the line 8—8 in FIG. 9 of a blade tennon, further illustrating the alternate embodiment shown in FIG. 7 and FIG. 9; and FIG. 9 is an exploded perspective view of a portion of a hockey stick according to one embodiment of the invention.

DESCRIPTION OF THE PREFERRED EMBODIMENTS

With reference to FIG. 1 of the drawings, which are provided for purposes of illustration, and not by way of limitation, a lower portion of a hockey stick 10 of one embodiment of the invention is shown. The hockey stick includes a shaft 12 having a lower connection portion 14 incorporating a socket 16. A blade 18 includes a shank or tennon 20 which is configured to be slidably received within the socket at the lower connection portion of the hockey stick shaft.

The shaft 12 can be formed of various materials as is known in the art, including for example aluminum alloys, and composite materials such as fiberglass and carbon fiber composites. The blade 18 is formed of wood, and may be reinforced with an overlay of fiberglass (not shown) for example, or could be formed of another material such as a polymeric resin or composite material such as a polymeric resin combined with reinforcing fibers (not shown).

In one embodiment of the invention, a quantity of wax (not shown) in a flowable state is applied in a relatively thin and uniform layer to interior surfaces of the socket 16, and outer surface of the blade tennon 20, or both. The tennon is then inserted into the socket, and allowed to cool. As will be apparent, in joining components where the wax has been previously so applied and allowed to cool, the wax is first heated, using heated water (stored in an insulated container for example), a hair dryer or other source of warm air, or hand warmth to soften it from a hard solid state to a flowable state. For example, the socket or tennon could be dipped into water heated to between 100 and 200 degrees fahrenheit and stored in an ordinary insulated cup or jug. Alternatively heated water can be poured over the socket and tennon prior to joining them. After joining the socket and tennon elements the joint is allowed to cool and the wax hardens. The same procedure can be used to subsequently separate the elements.

The configuration of the socket 16 and the tennon 20 are rectangular as is known in the art, and the outer surfaces of the tennon and the inner surfaces of the socket each comprise two sets of parallel surfaces orthogonally disposed relative to one another. The total clearance between the blade tennon 20 and the inner walls of the socket 16 is between 0 and 0.005 inches (0 and 0.13 millimeters). This means a clearance between 0 and 0.0025 of an inch (0 and 0.065 millimeters) on each side of the tennon between each of the two sets of parallel outer surfaces and the corresponding inner surfaces of the socket 16. It has been found when the clearance is held to this range that certain "tacky" waxes employed between the tennon 20 and the interior surfaces of the socket 16 will hold the blade tennon within the socket solidly when the temperature is low enough to maintain the wax in a non-flowable state, and will also prevent accidental removal of the tennon from the socket when the wax is in a flowable state. Heating of the blade tension 20 and socket 16 connection to allow separation can be done as mentioned by dipping the connection in hot water, or in another embodiment by application of warmth from the hands. Pouring hot water on the socket/tennon connection is another way to heat it. Brief application of heat from an electric heater, or by use of a source of hot air as a blow dryer are additional examples of methods adapted to effect loosening of the joint, enabling separation.

A hard steady pull is required to remove the blade tennon 20 from the socket 16. The tennon will slowly slide out of the socket in response to the hard steady pull when the wax is in a flowable state, but will not suddenly "fly-out" or otherwise suddenly disengage. It is the interaction of the wax with the walls of the socket and the blade tennon within this limited range of clearance that gives rise to the requirement of providing a long steady hard pull to remove the blade tennon from the socket, and allows intentional disconnection when the wax is heated to a temperature when it is in a flowable state. However, even in a flowable state the wax acts to resist unintentional separation, for example in response to a sudden sharp blow tending to separate the blade and shaft.

With reference to FIG. 2 of the drawings, in a further embodiment of the invention the blade tennon 20 of a wooden blade 18 is given a sandwich configuration including a central layer 22 of elastomeric material which allows compression of the blade tennon in one direction. When the blade tennon is inserted in the socket 16 of the shaft 12 a thin layer of wax 24 between the blade tennon and the interior of the socket again acts to resist relative movement between the blade tennon and the socket. This resistance to movement is enhanced by provision of a "pre-load," that is to say configuring the socket 16 and the blade tennon 20 to have an interference fit therebetween. At least one of the two elements (either the socket or the tennon) must deform upon insertion of the tennon into the socket. In this embodiment, the tennon deforms elastically and this deformation is facilitated by the layer 22 of elastomeric material provided.

Deformation of the blade tennon 20 gives rise to a rebound force acting between the tennon and the socket 16 in a direction orthogonal to the direction of movement of the blade tennon 20 with respect to the socket 16 in insertion or removal of the blade tennon into or from the socket, and tends to thin the layer of wax 24 between the outer surface 26 of the blade tennon and the inner surface 28 of the socket 16. With the application of these forces the resistance to relative movement between the blade tennon 20 and the socket 16 is very high even at elevated temperatures when the wax 24 is flowable.

Further appreciation of this embodiment can be had with reference to FIG. 3 which shows the sandwich construction of the blade tennon 20 from a direction orthogonal to that of FIG. 2. As can be appreciated, the elastomeric layer 22 gives rise to increased elastic deformability of the blade tennon and allows the tennon to be made larger than the socket in a dimension orthogonal to this layer and provides a tight interference fit between the tennon and surfaces 26*a* and 26*b* shown in FIG. 3. Accordingly, the clearances between the tennon and those surfaces, which is filled with wax is small to non-existent and configuration mitigates the difficulty of controlling the manufacturing process for wooden blades for example to provide tolerances sufficiently small to provide the clearances mentioned above.

In an alternate embodiment, shown in FIG. 3*a*, the elastomeric layer 22 is disposed diagonally. Deformation of this layer thus configured allows the elastic deformation of the tennon 20 so as to give rise to a rebound force acting not only through surfaces 26*a* and 26*b*, but also 26*c* and 26*d* disposed orthogonally to surfaces 26*a* and 26*b*. This provides the benefits discussed above in relation to both sets of corresponding parallel surfaces of the interior of the socket 16 and the outer surfaces of the blade tennon 20.

With reference again to FIG. 2, each of the sandwich construction embodiments described also includes a stress relief portion 30 adjacent the elastomeric layer 22 to lessen the tendency of the wood or other material from which the blade 18 is constructed to crack or otherwise fail at localized stress concentrations adjacent the elastomeric layer 22. The embodiments of FIGS. 2, 3 and 3*a* still allow removal of the tennon from the socket by softening the wax by applying heat to the connecting portion 14, so as to make the wax flowable, and applying a long steady pull to the blade.

Turning now to FIG. 4 in a further embodiment the shaft 12 at the lower connection portion 14 is given an inwardly bowed configuration so that the socket 16 comprises inwardly protruding convex surfaces 28*a*, 28*b*, 28*c*, 28*d*. This configuration, as can be appreciated, gives rise to an interference fit between the blade tennon 20 and the socket 16. In this embodiment, whether the blade tennon 20 elastically deforms or not the shaft 12 comprising the socket 16 deforms upon insertion of the blade tennon within the elastic range of the material from which the shaft 12 is formed, thus providing a rebound force giving rise to increased resistance to relative movement between the blade tennon 20 and the socket 16 in a way similar to that described above. Removal of the blade 18 from the shaft is also possible in this embodiment by providing a long steady pull after warming the wax.

These effects can also be achieved by the further alternate embodiments of FIGS. 5 and 6. In FIG. 5 the walls of the socket 16 formed by the lower connection portion 14 of the shaft 12 are thickened so as to also give rise to an inwardly protruding convex shape within the socket 16. Likewise, as illustrated in FIG. 6, provision of axially disposed beads 32*a*, 32*b*, 32*c*, 32*d* which also protrude inwardly within the socket 16 give rise to an interference fit between the blade tennon 20 and the socket 16 resulting in deformation of the shaft 12 comprising the walls of the socket 16 or the blade tennon 20, or both. Again, as can be appreciated, deformation of these elements of the connection between the blade 18 and the shaft 12 provides a rebound force increasing the resistance to separation of the joint elements in a way similar to that discussed above. Separation of the blade tennon and socket joint elements of this embodiment is also carried out in the same way as with the other embodiments.

With reference to FIGS. 7, 8 and 9 a further embodiment of the invention provides resistance to relative movement between the blade tennon 20 and the socket 16 by means of a mechanical interference between the blade tennon and the socket. In this embodiment convex inwardly protruding bumps 34*a*, 34*b*, 34*c*, 34*d* formed in the shaft 12 at the socket cooperate with corresponding indentations 36*a*, 36*b*, 36*c*, 36*d* in the blade tennon to resist relative movement between the tennon and the socket when the tennon is inserted deeply enough in the socket to reach a first position (not shown) where the inwardly protruding convex surfaces 34*a*, 34*b*, 34*c*, 34*d* protrude within and fill convex indentations 36*a*, 36*b*, 36*c*, 36*d* in the tennon 20. In removing the blade tennon from the socket the wax is made flowable and the blade tennon is moved to a second position (not shown) where the inwardly protruding convex surfaces 34*a*, 34*b*, 34*c*, 34*d* do not correspond with the location of the concave indentations 36*a*, 36*b*, 36*c*, 36*d* in the blade tennon. Commensurately, deformation of at least one of the two connection elements comprising the socket 16 and the tennon 20 must occur in such movement of a blade tennon from the first position to the second position. Resistance to this deformation provides a resistance to relative movement between the blade tennon and the socket. Even when the wax is in a flowable state, the blade 18 will remain connected to shaft 12 unless a long steady pull, sufficient to overcome the resistance of the deformation occasioned by the above discussed mechanical interference as well as the resistance provided by the wax, is applied.

As with the other embodiments described, the embodiment of FIGS. 7–9 allows the blade 18 to be removed from the shaft 12 by warming the lower connection portion 14 of the shaft so as to make the wax flowable. However, here again even when the wax is in a flowable state, the blade 18 cannot be removed by a quickly applied temporary force, for example such as might be occasioned by a blow, and accordingly the blade tennon 20 is retained in the socket 16 of the shaft.

It has been found that embodiments employing the pre-load and interlock features described in connection with FIGS. 2–9 can be used in street hockey play as well as in ice hockey. Though temperatures encountered in street hockey play are higher than those normally encountered in ice hockey play the combination of a pre-load feature with the use of wax retains the blade firmly in such play.

Turning now to discussion of the wax in more detail, it must be remembered that in addition to maintaining the connection of the blade 18 with the shaft 12, the wax must provide a solid connection so that the hockey stick has the correct feel during play. The wax acts as an adhesive and firmly joins the two elements of the connection (the blade tennon 20 and the socket 16) together during play. Furthermore, it is desireable that the wax remain "tacky" even when in a flowable state so as to resist separation of the blade 18 from the shaft even when the stick is exposed to elevated temperatures. For example, a hockey stick used in ice hockey play might be stored in a closed parked car exposed to direct sunlight. Obviously the interior portion of such a car where the hockey stick may be located can become quite hot.

It is desireable that the connection between the blade 18 and the shaft 12 remain intact and that no wax becomes so flowable as to drip from the hockey stick joint.

In a presently preferred embodiment waxes that have been found to work well include those manufactured and sold under the trademarks QUAKE WAX, Multiwax X-145A; Multiwax W445, and KIDS WAX by Conservation Materials Ltd. of Sparks, Nev. These waxes are microcrystalline wax blends characterizable as follows:

| WAX PRODUCT | SOFTENING POINT in deg. F. |
|---|---|
| QUAKE WAX | 170–175 |
| MULTIWAX X-145 A | 160–170, needle penetration = 34/45 mm. |
| MULTIWAX W445 | 170–180, needle penetration = 25/35 mm. |
| KIDSWAX | 165–175 |

The softening point is quantified under an ASTM D-127 test method.

These waxes work best when the total clearance between the outer surface of the blade tennon 28 and the interior surface 28 of the socket 16 is a total of between 0 and 0.005 of an inch (0 and 0.13 millimeters), being between 0 and 0.0025 of an inch (0 and 0.065 millimeters) on each side of the blade tennon as discussed above. Moreover, these waxes seem to work well despite the presence of mold release agents on component surfaces. This latter point is particularly relevant to composite sticks 12 and blades 18 which may be manufactured using molding processes.

MULTI WAX X-145A and MULTI WAX W-445, work as described where a "pre-load" is provided. As mentioned, a "pre-load" refers to providing a rebound force between the blade tennon 20 and socket 16 elements enhancing resistance to relative movement therebetween. However, these latter two waxes have not been found to work well in embodiments which do not incorporate a pre-load (that is to say some kind of interference fit).

Addressing a final important point, as can be appreciated it may be desirable to adapt a shaft which was previously used with a "hot melt" glue connection system to the wax joint system of the present invention. It is been found that shafts can be so used when care is taken in using the wax joint system for the first time. In one embodiment in a shaft which was previously used with hot melt glue (and on which hot melt glue remains, adhering to the interior surface 28 of the socket 16) adaption is accomplished by heating the socket in accordance with manufacturers' recommendations to melt the hot melt glue the first time the wax joint is established.

A blade 18 having a blade tennon 20 coated with wax is inserted into the socket while the socket remains at a sufficiently elevated temperature to assure the hot melt glue adhering to the inner surface thereof is still flowable. The wax on the blade tennon melts in this process, allowing insertion of the blade. After the joint has cooled, an effective connection is obtained which can subsequently be separated by application of much less heat. The heat thereafter required to replace the blade is only as may be required to melt the wax sufficiently to bring it to a flowable state. Thereupon the joint can be separated by application of sufficient constant force for the sufficiently long time to remove the blade tennon from the socket as before described.

In adapting such a stick the hot melt glue apparently deforms so as to provide the necessary small clearances between the socket and the blade tennon for the wax joint system to work properly. The wax apparently prevents the hot melt glue from adhering directly to the blade tennon. Therefore in such an adapted shaft the hot melt glue cooperates with the wax to provide the wax joint system of the invention. As long as the joint is not subsequently heated so as to melt the hot melt glue, the joint can be thereafter used solely with the wax joint system and application of the commensurately lower amounts of heat in blade replacement.

Persons skilled in the art will readily appreciate that various modifications can be made from the preferred embodiments and remain within the scope of the invention, and accordingly the scope of protection afforded is intended to be limited only by the appended claims.

I claim:

1. A hockey stick of the type having two separable segments comprising:

a shaft segment, a blade segment, a releasable connection between the shaft and blade segments, said releasable connection further comprising a socket, a tennon configured to be removably received in the socket, and a wax disposed between said tennon and said socket, said wax being adapted to retain the tennon in the socket at temperatures encountered during hockey play and allow removal of the blade tennon from the socket at temperatures above those encountered during hockey play, the wax being selected to soften and become more flowable upon warming to a such a temperature, the socket configuration and tennon configuration and wax cooperating to retain the tennon in the socket until the connection between the shaft segment and blade segment is intentionally released and the blade tennon is removed from the socket, wherein there is an interference fit between said socket and said blade tennon, and further comprising an inwardly protruding portion of an inner wall of said socket protruding into said socket, said inwardly protruding portion giving rise to an interference fit between said socket and said blade tennon, and wherein said socket has four orthogaonally disposed inner wall surfaces, forming a parallelogram shaped socket, and further comprising a portion of a wall of said socket bowed inwardly so as to protrude convexly into the interior of the socket, said convexly inwardly protruding wall giving rise to elastic deformation of at least one of the joint connection elements consisting of the socket and blade tennon upon insertion of the blade tennon into the socket.

2. The hockey stick of claim 1 wherein a clearance between the tennon and the socket does not exceed and five thousandths of an inch total, being not more than and two and one half thousandths of an inch on each side of the tennon.

3. The hockey stick of claim 1 further comprising a deformable socket which elastically deforms upon insertion of the blade tennon and thereby applies a rebound force to said tennon acting to increase frictional resistance to relative movement between said socket and said tennon.

4. The hockey stick of claim 1 further comprising a deformable blade tennon which elastically deforms when said blade tennon is inserted in the socket and thereby applies a rebound force to said socket acting to increase frictional resistance to relative movement between said tennon and said socket.

5. The hockey stick of claim 4, wherein said blade tennon has a sandwich construction and further comprises an elastomeric layer formed of an elastically deformable material having greater elasticity than the material forming the rest of the blade tennon.

6. The hockey stick of claim 1 wherein said blade tennon has a first position and a second position within said socket, the first position being where the blade tennon is inserted relatively more deeply in the socket and is positioned for play, and the second position being a position of the tennon less deeply inserted than the first position, said releasable connection further comprising a mechanical interference between said blade tennon and said socket, said mechanical interference necessitating deformation of at least one of the two connection elements consisting of the blade tennon and the socket in order to insert said tennon in said socket or remove said tennon from said socket, the deformation of the at least one of the two connection elements being lessened when the blade tennon is inserted in the socket sufficiently far to reach the first position and said deformation being greater at the second position, whereby movement of the blade tennon within the socket from the first position to the second position is resisted.

7. The hockey stick of claim 6 further comprising an inward convex protrusion within said socket, said protrusion protruding into the socket, and a corresponding concave depression in the blade tennon cooperating with the protrusion within said socket to retain the blade tennon in the socket.

8. The hockey stick of claim 1, wherein said socket has four orthogonally disposed inner wall surfaces together forming a parallelogram shaped socket, and further comprising an inwardly protruding bead disposed axially along the inner surface of the socket.

* * * * *